US012800204B2

(12) United States Patent
Toyooka

(10) Patent No.: US 12,800,204 B2
(45) Date of Patent: Nov. 17, 2026

(54) METHOD FOR CHARGING REFRIGERANT

(71) Applicant: PHC Holdings Corporation, Tokyo (JP)

(72) Inventor: Takashi Toyooka, Saitama (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 104 days.

(21) Appl. No.: 18/895,993

(22) Filed: Sep. 25, 2024

(65) Prior Publication Data

US 2025/0012496 A1 Jan. 9, 2025

Related U.S. Application Data

(63) Continuation of application No. PCT/JP2023/003193, filed on Feb. 1, 2023.

(30) Foreign Application Priority Data

Mar. 29, 2022 (JP) ..... 2022-054135

(51) Int. Cl.
*F25B 45/00* (2006.01)

(52) U.S. Cl.
CPC ..... *F25B 45/00* (2013.01); *F25B 2345/001* (2013.01)

(58) Field of Classification Search
CPC ..... F25B 45/00; F25B 2345/00–2345/007
See application file for complete search history.

(56) References Cited

U.S. PATENT DOCUMENTS 3,785,163 A * 1/1974 Wagner ..... F17C 6/00 62/149
5,970,721 A 10/1999 Kamimura et al.
5,975,151 A * 11/1999 Packo ..... F25B 45/00 141/3

(Continued)

FOREIGN PATENT DOCUMENTS

CN 204438583 U * 7/2015
JP 08-193762 A 7/1996

(Continued)

OTHER PUBLICATIONS

Machine English language translation of CN204438583 to Liu et al. Translated Mar. 2026 (Year: 2015).*

(Continued)

*Primary Examiner* — Cassey D Bauer
(74) *Attorney, Agent, or Firm* — Rimon P.C.

(57) ABSTRACT

A refrigerant charging method is for charging a refrigerant into a refrigeration circuit including a compressor, a condenser, a throttle device, an evaporator, and a first port that is disposed in a high pressure portion of the compressor or in a location downstream of the compressor and upstream of the throttle device. The method includes: connecting, to the first port, a mouth of a container in which the refrigerant including a high boiling point refrigerant in a liquid state and a medium boiling point refrigerant having a boiling point lower than that of the high boiling point refrigerant and in a wet gas state is enclosed; and charging at least a portion of the refrigerant in the container into the refrigeration circuit through the first port from the container in a position such that the mouth faces downward.

9 Claims, 3 Drawing Sheets

(56) References Cited

U.S. PATENT DOCUMENTS

2021/0140685 A1* 5/2021 Yamawaki ..... F25B 6/02

FOREIGN PATENT DOCUMENTS

| | | | |
|---|---|---|---|
| JP | H08-200897 | A | 8/1996 |
| JP | 10-281597 | A | 10/1998 |
| JP | 11-270933 | A | 10/1999 |

OTHER PUBLICATIONS

Extended European Search Report dated May 21, 2025 issued in the corresponding European Patent Application No. 23778825.2.
International Search Report dated Mar. 14, 2023 issued in International Patent Application No. PCT/JP2023/003193, with English translation.

* cited by examiner

METHOD FOR CHARGING REFRIGERANT

CROSS-REFERENCE OF RELATED APPLICATIONS

This application is a Continuation of International Patent Application No. PCT/JP2023/003193, filed on Feb. 1, 2023, which in turn claims the benefit of Japanese Patent Application No. 2022-054135, filed on Mar. 29, 2022, the entire disclosure of which Applications are incorporated by reference herein.

TECHNICAL FIELD

The present invention relates to a method for charging a refrigerant (refrigerant charging method).

BACKGROUND ART

Patent Literature (hereinafter, referred to as PTL) 1 discloses a method for filling a refrigerant circuit with a non-azeotropic refrigerant mixture by using a tank that contains the non-azeotropic refrigerant mixture at an amount that can be filled at one time. In this method, the refrigerant circuit is applied to an air conditioner, and R407C is used as the non-azeotropic refrigerant mixture.

R407C is composed of HFC32 (boiling point: −51.7° C.), HFC125 (boiling point: −48.5° C.), and HFC134a (boiling point: −26.5° C.). The boiling points of these three refrigerants are relatively close to each other. Therefore, these three types of refrigerants are considered to be mixed relatively evenly in the tank at room temperature before being charged into the refrigerant circuit.

CITATION LIST

Patent Literature

PTL 1

Japanese Patent Application Laid-Open No. H08-200897

SUMMARY OF INVENTION

Technical Problem

For example, some non-azeotropic refrigerant mixtures are composed of a plurality of refrigerants having boiling points significantly different to each other, such as a non-azeotropic refrigerant mixture that is configured to fill a refrigeration circuit of an ultra-low temperature freezer that achieves an extremely low temperature of −80° C. or less. These plurality of refrigerants may be in a state such that the refrigerants are separated from each another in a sealed container before being charged into the refrigeration circuit. There is a demand for a method for reliably charging a non-azeotropic refrigerant mixture in such a state into a refrigeration circuit.

An object of the present disclosure is to provide a refrigerant charging method capable of reliably charging a non-azeotropic refrigerant mixture into a refrigeration circuit.

Solution to Problem

A refrigerant charging method according to the present disclosure is: a method for charging a refrigerant into a refrigeration circuit that includes a compressor, a condenser, a throttle device, an evaporator, and a first port, the first port being disposed in a high pressure portion of the compressor or in a location downstream of the compressor and upstream of the throttle device, the method including:

connecting, to the first port, a mouth of a container in which the refrigerant is enclosed, the refrigerant including a high boiling point refrigerant in a liquid state and a medium boiling point refrigerant having a boiling point lower than that of the high boiling point refrigerant and in a wet gas state; and charging at least a portion of the refrigerant in the container into the refrigeration circuit through the first port from the container, the container being in a position such that the mouth faces downward.

Advantageous Effects of Invention

The present disclosure can provide a refrigerant charging method capable of reliably charging a non-azeotropic refrigerant mixture into a refrigeration circuit.

DESCRIPTION OF EMBODIMENTS

Figure 1:
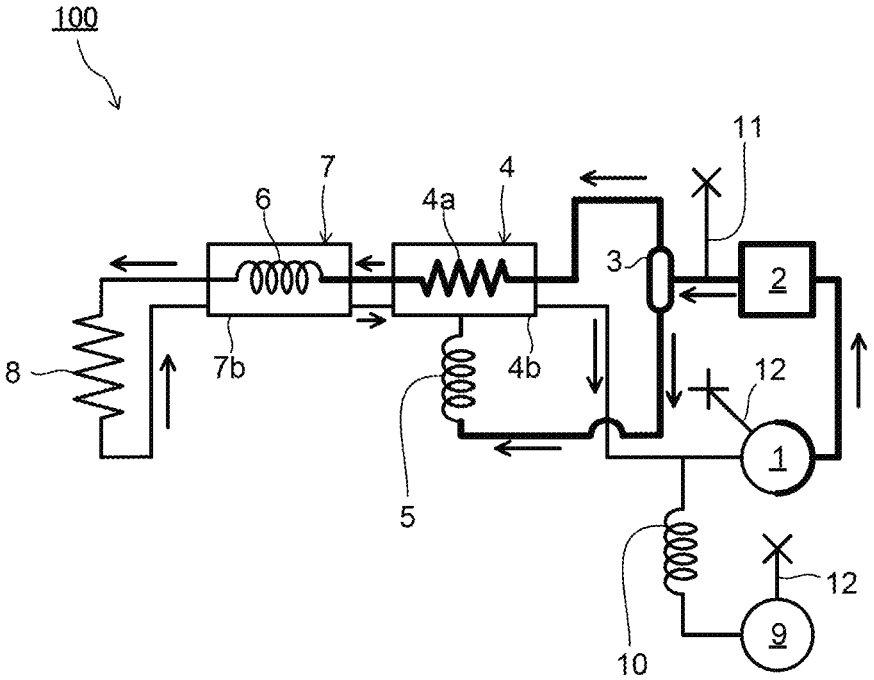
FIG. 1 illustrates an exemplary refrigeration circuit.

FIG. 1 illustrates an overview of refrigeration circuit 100 according to an embodiment of the present disclosure. Refrigeration circuit 100 is applied to a refrigeration apparatus such as an ultra-low temperature freezer.

Refrigeration circuit 100 includes compressor 1, condenser 2, gas-liquid separator 3, first heat exchanger 4, auxiliary throttle device 5, throttle device 6, second heat exchanger 7, and evaporator 8. Refrigeration circuit 100 may further include refrigerant tank 9 and throttle device 10 for connecting the refrigerant tank (herein also referred to as "refrigerant tank connecting throttle device").

In FIG. 1, the lines connecting the above-described elements constituting refrigeration circuit 100 indicate pipes, and the arrows in FIG. 1 each indicate the flow of a refrigerant in a pipe. The refrigerant flowing through refrigeration circuit 100 is a non-azeotropic refrigerant mixture, which is a mixture of refrigerants having boiling points different to each other. The non-azeotropic refrigerant mixture contains a high boiling point refrigerant, a medium boiling point refrigerant having a boiling point lower than that of the high boiling point refrigerant, and a low boiling point refrigerant having a boiling point lower than that of the medium boiling point refrigerant. Hereinafter, the non-azeotropic refrigerant mixture may be simply referred to as a refrigerant.

Compressor 1 compresses a sucked refrigerant and discharges the refrigerant into a pipe. The discharged refrigerant flows into condenser 2 through the pipe. Compressor 1 includes a low pressure portion (containing the refrigerant before being compressed) between a suction port that sucks in the refrigerant and a region that compresses the refrigerant (for example, a cylinder), and a high pressure portion (containing the refrigerant after being compressed) between the region compressing the refrigerant and a discharge port that discharges the compressed refrigerant.

Condenser 2 is a heat exchanger equipped with a fan that is rotated by a fan motor. Condenser 2 is a heat exchanger that cools a refrigerant by exchanging heat with the surrounding air sent in by the fan, and condenses at least a portion of the refrigerant. The refrigerant that has passed through condenser 2 flows into gas-liquid separator 3.

Gas-liquid separator 3 is a container that separates the refrigerant into gas and liquid. A refrigerant in a gas state, namely a component (component with a relatively low boiling point) which is not condensed in condenser 2, flows out from gas-liquid separator 3 in the gas state and into inner tube 4*a* of first heat exchanger 4. A refrigerant in a liquid state, namely a component (component with a relatively high boiling point) which is condensed in condenser 2, flows out from gas-liquid separator 3 and into auxiliary throttle device 5.

Auxiliary throttle device 5 is, for example, a capillary tube. When passing through auxiliary throttle device 5, the refrigerant is throttled and expanded to lower the pressure and temperature of the refrigerant. The refrigerant flowing out from auxiliary throttle device 5 flows into outer tube 4*b* of first heat exchanger 4.

First heat exchanger 4 is a heat exchanger including inner tube 4*a* and outer tube 4*b* surrounding inner tube 4*a*. A refrigerant flowing through inner tube 4*a* exchanges heat with a refrigerant flowing through outer tube 4*b*, and loses heat.

The refrigerant flowing out from inner tube 4*a* of first heat exchanger 4 flows into throttle device 6. Throttle device 6 is, for example, a capillary tube. When passing through throttle device 6, the refrigerant is throttled and expanded to lower the pressure and temperature of the refrigerant.

In addition, throttle device 6 constitutes second heat exchanger 7 together with outer tube 7*b* of second heat exchanger 7. Throttle device 6 is surrounded by outer tube 7*b*. Therefore, a refrigerant passing through throttle device 6 exchanges heat with a refrigerant passing through outer tube 7*b* to lose heat, becoming even lower in temperature.

In the process of passing through inner tube 4*a* of first heat exchanger 4 and throttle device 6, the refrigerant passing therethrough is condensed.

The refrigerant flowing out from throttle device 6 flows into evaporator 8 and evaporates. At this time, the surrounding of evaporator 8, that is, the object to be cooled, is cooled.

The refrigerant flowing out from evaporator 8 flows into outer tube 7*b* of second heat exchanger 7, absorbs heat from a refrigerant flowing through throttle device 6, and flows out from outer tube 7*b*.

The refrigerant flowing out from outer tube 7*b* flows into outer tube 4*b* of first heat exchanger 4, and joins to mix with a refrigerant flowing out from auxiliary throttle device 5. The mixed refrigerant absorbs heat from a refrigerant flowing through inner tube 4*a* of first heat exchanger 4, evaporates completely, and flows out from outer tube 4*b*.

The refrigerant flowing out from outer tube 4*b* is sucked into compressor 1, compressed again, and discharged.

Refrigerant tank 9 may be connected via refrigerant tank connecting throttle device 10 to a pipe located downstream of outer tube 4*b* and upstream of compressor 1.

Refrigeration circuit 100 configured as described above is divided, with compressor 1 and throttle device 6 as boundaries, into a high pressure circuit with a high pressure refrigerant therein, and a low pressure circuit with a low pressure refrigerant therein. In FIG. 1, the portion constituting the high pressure circuit is indicated by bold lines. The high pressure circuit includes the high pressure portion of compressor 1 and a portion located downstream of compressor 1 and upstream of throttle device 6. The high pressure circuit also includes a portion between gas-liquid separator 3 and auxiliary throttle device 5. In addition, the low pressure circuit includes the low pressure portion of compressor 1 and a portion located upstream of compressor 1 and downstream of throttle device 6. The low pressure circuit also includes refrigerant tank 9 and refrigerant tank connecting throttle device 10.

First port 11 is disposed at the high pressure circuit. Second port 12 is disposed at the low pressure circuit. First port 11 is provided, for example, at a pipe located downstream of condenser 2 and upstream of gas-liquid separator 3 as illustrated in FIG. 1. Second ports 12 are provided, for example, at the low pressure portion of compressor 1 and at refrigerant tank 9 as illustrated in FIG. 1. These ports are normally closed and are connected to a refrigerant supply source for charging a refrigerant into refrigeration circuit 100 for the first time or for charging a refrigerant for refilling. The refrigerant is charged into refrigeration circuit 100 from the refrigerant supply source through each port. The numbers of first ports 11 and second ports 12 are not limited to that illustrated in the drawing.

Figure 2:
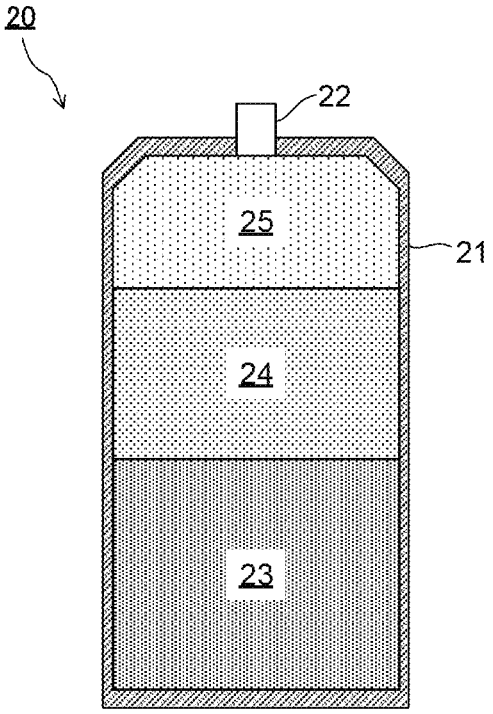
FIG. 2 schematically illustrates a container and refrigerants therein.

FIG. 2 is a schematic cross-sectional view of container 20 (filled with a refrigerant) which is a refrigerant supply source. Container 20 includes container main body 21 and mouth 22. Container main body 21 includes a cylindrical side wall, and a bottom and a ceiling part that close both ends of the side wall. Mouth 22 is provided at the ceiling part. Container 20 is, for example, a tank. Container 20 does not include a siphon tube, and therefore container 20 can be easily produced. Container 20 may include a short siphon tube that does not reach the bottom of container 20. In this case, a side hole may be formed near the base (end part of the siphon tube on the ceiling part side) of the siphon tube. Forming a side hole allows high boiling point refrigerant 23 in a liquid form to be discharged from container 20 through the siphon tube when container 20 is placed in a position such that mouth 22 faces downward as described below.

Container 20 has a shape that allows the container to be stably placed on a horizontal surface with the bottom part of container main body 21 at a lower location and the ceiling part, namely mouth 22, at a higher location. In other words, container 20 can stand on a horizontal surface. FIG. 2 illustrates container 20 with mouth 22 facing upward (that is, container 20 is in an upright position). Container 20 may have any shape as long as the container includes mouth 22.

Container 20 contains enclosed therein a non-azeotropic refrigerant mixture including high boiling point refrigerant 23, medium boiling point refrigerant 24 having a boiling point lower than that of high boiling point refrigerant 23, and low boiling point refrigerant 25 having a boiling point lower than that of the medium boiling point refrigerant.

When container 20 is allowed to stand in a room temperature environment, high boiling point refrigerant 23 is in a liquid state, medium boiling point refrigerant 24 is in a wet gas state, and low boiling point refrigerant 25 is in a gas state inside container 20. Therefore, the three refrigerants are in a substantially separated state in container 20.

When container 20 is in an upright position, high boiling point refrigerant 23 in a liquid state is located near the bottom of container main body 21, low boiling point refrigerant 25 in a gas state is located near mouth 22, and medium boiling point refrigerant 24 in a wet gas state is located between high boiling point refrigerant 23 and low boiling point refrigerant 25.

Figure 3:
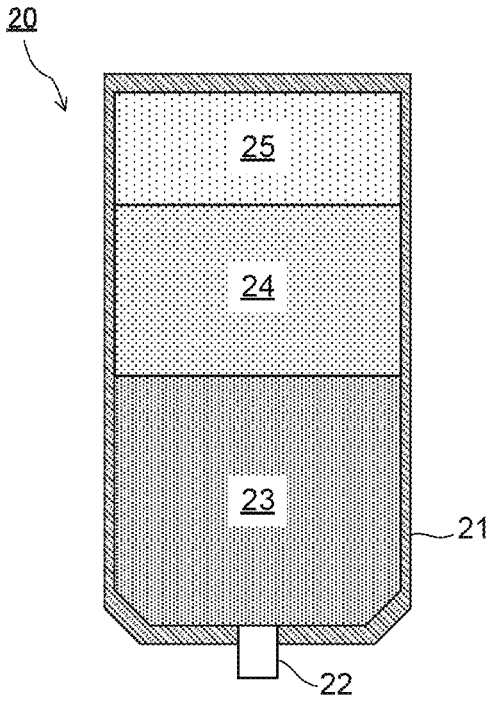
FIG. 3 schematically illustrates a container and refrigerants therein.

When container 20 is upside down, that is, when mouth 22 faces downward, high boiling point refrigerant 23 in a liquid state is located near mouth 22, low boiling point refrigerant 25 in a gas state is located near the bottom of container main body 21, and medium boiling point refrigerant 24 in a wet gas state is located between high boiling point refrigerant 23 and low boiling point refrigerant 25, as illustrated in FIG. 3.

High boiling point refrigerant 23, medium boiling point refrigerant 24, and low boiling point refrigerant 25 may be any refrigerants as long as the refrigerants are respectively in a liquid state, a wet gas state, and a gas state in container 20 placed in a room temperature environment. For example, high boiling point refrigerant 23 is normal butane, medium boiling point refrigerant 24 is ethane, and low boiling point refrigerant 25 is methane. High boiling point refrigerant 23 may be normal butane or isobutane, medium boiling point refrigerant 24 may be ethane, ethylene, or xenon, and low boiling point refrigerant 25 may be methane or krypton.

When the non-azeotropic refrigerant mixture is formed of a combination of hydrocarbons, the total weight of the non-azeotropic refrigerant mixture may be 150 g or less. By keeping the total weight below 150 g, it is possible to comply with International Electrotechnical Commission (IEC) standards. Furthermore, a hydrocarbon gas and a rare gas can reduce the environmental load.

The ratio of refrigerants enclosed in container 20 is such that, for example, high boiling point refrigerant 23 is 50 wt % or more and 80 wt % or less, medium boiling point refrigerant 24 is 10 wt % or more and less than 50 wt %, and low boiling point refrigerant 25 is 20 wt % or less, with the total of the contents of container 20 (namely, non-azeotropic refrigerant mixture) being 100 wt %. In other words, the total amount of medium boiling point refrigerant 24 and low boiling point refrigerant 25 is 50 mass % or less. The low boiling refrigerant may be entirely replaced with a medium boiling refrigerant.

A refrigerant is charged from container 20, which is a refrigerant supply source, into refrigeration circuit 100 as follows. The charging of the refrigerant is performed before refrigeration circuit 100 starts operating, or when a refrigerant leak occurs after refrigeration circuit 100 starts operating. For example, the charging is performed when a state, in which a lubricating oil for lubricating compressor 1 tends to accumulate in evaporator 8, continues for a certain period of time (for example, after a power failure occurs when the temperature is low and the system is left unattended for a while), and further when a refrigerant leaks.

First, first port 11 is connected with mouth 22 via a valve and a pipe. Container 20 may include a valve attached to mouth 22. At substantially the same time, container 20 is placed in the position illustrated in FIG. 3, that is, in a position such that mouth 22 faces downward.

The valve is then opened. Before the valve is opened, the pressure inside the refrigeration circuit 100 may be reduced. The pressure can be reduced by, for example, sucking from the inside of refrigeration circuit 100 with a vacuum pump through at least one of first port 11 and second port 12. When the valve is opened, the refrigerant enclosed in container 20 is charged into refrigeration circuit 100 through first port 11. In particular, high boiling point refrigerant 23 located near mouth 22 is charged first, then the medium boiling point refrigerant is charged, and finally the low boiling point refrigerant is charged.

High boiling point refrigerant 23 having charged first permeates through the high pressure circuit. Subsequently, high boiling point refrigerant 23 enters throttle device 6 and auxiliary throttle device 5, which have large piping resistance, and passes through the devices, and then enters the low pressure circuit. Due to the structure of compressor 1, the refrigerant cannot flow from the high pressure portion to the low pressure portion in compressor 1.

The force pushing high boiling point refrigerant 23 having entered throttle device 6 and auxiliary throttle device 5, which have a large piping resistance, toward the low pressure circuit is provided by medium boiling point refrigerant 24 and low boiling point refrigerant 25 in container 20. This is because medium boiling point refrigerant 24 and low boiling point refrigerant 25 have lower boiling points than high boiling point refrigerant 23 and thus would have higher pressures than high boiling point refrigerant 23 when the refrigerants are in the same temperature environment. In other words, high boiling point refrigerant 23, which has permeated through the high pressure circuit, is pushed by medium boiling point refrigerant 24 and low boiling point refrigerant 25 in container 20, enters throttle device 6 and auxiliary throttle device 5 and passes through throttle device 6 and auxiliary throttle device 5. Following high boiling point refrigerant 23, medium boiling point refrigerant 24 and low boiling point refrigerant 25 can then enter the high pressure circuit.

When substantially all of the high boiling point refrigerant 23 has been charged into refrigeration circuit 100, medium boiling point refrigerant 24 is then charged into refrigeration circuit 100, and finally low boiling point refrigerant 25 is charged into refrigeration circuit 100. As the charging of the refrigerants progresses, the pressure of the refrigerants in refrigeration circuit 100 increases, but as low boiling point refrigerant 25 charged last is the refrigerant with the highest pressure in the same temperature environment, it is possible to charge substantially the entire amount of refrigerants into container 20.

However, while the refrigerants are being charged, the refrigerant pressure at least in the high pressure circuit portion gradually increases. Therefore, while a refrigerant remains in container 20, the following may occur: the refrigerant cannot enter refrigeration circuit 100 from first port 11 or enters refrigeration circuit 100 but with difficulty. In this case, a step may be performed as follows.

That is, after charging the refrigerants in container 20 into refrigeration circuit 100 through first port 11, at least a portion of a refrigerant remaining in container 20 may be charged into refrigeration circuit 100 through second port 12. The low pressure circuit provided with second port 12 is located downstream of throttle device 6 and auxiliary throttle device 5, which have large piping resistance, as viewed from first port 11. Due to the structure, even when high boiling point refrigerant 23 is charged into the high pressure circuit upstream of throttle device 6 and auxiliary throttle device 5, high boiling point refrigerant 23 cannot immediately flow into the low pressure circuit. That is, the low pressure state of the low pressure circuit continues for at least a certain period of time after the start of refrigerant charging. Therefore, even when the refrigerant remaining in container 20 can no longer enter refrigeration circuit 100 (specifically, the high pressure circuit) from first port 11, the low boiling point refrigerant and the medium boiling point refrigerant remaining in container 20 can be introduced into the refrigerant circuit (specifically, the low pressure circuit) from second port 12.

At this time, the position of the container 20 may be such that the mouth 22 faces upward or downward, and in either case, the entire amount of the refrigeration remaining in container 20 can be reliably charged to refrigeration circuit 100.

When the refrigerant charged from first port 11 is sufficient, refrigeration circuit 100 does not need to include second port 12.

In addition, the refrigerant inlet can be switched from first port 11 to second port 12 by disconnecting container 20 from first port 11 and then connecting container 20 to second port 12 via a pipe and a valve. A below described jig 30 may also be used.

Figure 4:
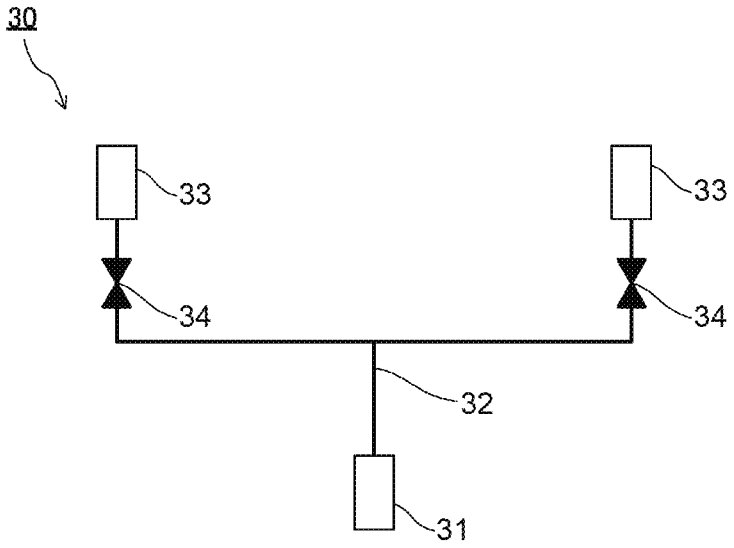
FIG. 4 schematically illustrates a jig.

FIG. 4 schematically illustrates jig 30. Jig 30 includes container connection port 31, branch pipe 32, two port connection ports 33, and two valves 34. The two valves 34 constitute a path switching device.

Container connection port 31 is a connection part that is connected to mouth 22 of container 20. Branch pipe 32 is composed of pipes having a shape such that one pipe branches into two pipes, and container connection port 31 is attached to the end part of the one pipe before the branching. In addition, port connection port 33 is attached to each of the end parts of the two pipes of branch pipe 32 after the branching. Port connection port 33 is a connection part that is connected to first port 11 or second port 12. Valve 34 is attached to each of the two pipes of branch pipe 32 after the branching.

When such a jig 30 is used, a refrigerant is charged from container 20 to refrigeration circuit 100 as follows. First, the two valves 34 are closed. Mouth 22 of container 20 is connected to container connection port 31, one of port connection ports 33 is connected to first port 11, and the other one of port connection ports 33 is connected to second port 12. At substantially the same time as these connections, container 20 is placed in a position with mouth 22 facing downward.

Valve 34 attached to the pipe connected to first port 11 is then opened the pipe being one of the two pipes of branch pipe 32 after the branching. A refrigerant enclosed in container 20 is then charged into refrigeration circuit 100 through first port 11. In particular, high boiling point refrigerant 23 located near mouth 22 is charged first.

After a certain period of time has elapsed, valve 34 attached to the pipe connected to first port 11 is closed, and then valve 34 attached to the pipe connected to second port 12 is opened. That is, the refrigerant paths are switched by the path switching device. The refrigerant remaining in container 20 is then charged into refrigerant circuit from second port 12. The switching between opening and closing of valves 34 may be performed as follows: while the weight of container 20 is measured, and when the weight reaches a predetermined value, or when a pressure gauge attached to refrigeration circuit 100, jig 30, or container 20 indicates a predetermined pressure, the opening and closing are switched.

Using jig 30 can easily change the location at which the refrigerant is charged from container 20 to refrigeration circuit 100, thereby reliably charging the refrigerant in container 20 into refrigeration circuit 100.

Alternatively, mouth 22 of container 20 may be connected to second port 12 in place of first port 11, and the refrigerant may be charged into refrigeration circuit 100 through second port 12 from the beginning. In this case, container 20 is placed in a position such that mouth 22 faces upward (i.e., in an upright position). That is, low boiling point refrigerant 25 located near the top of container 20 is charged first into refrigeration circuit 100 (specifically, into the low pressure circuit). Medium boiling point refrigerant 24 is then charged into refrigeration circuit 100.

When container 20 is in the upright position, high boiling point refrigerant 23 in a liquid state is located at the bottom of container 20 and cannot enter refrigeration circuit 100. After low boiling point refrigerant 25 and medium boiling point refrigerant 24 are charged into refrigeration circuit 100 through second port 12, the position of container 20 is thus changed so that mouth 22 faces downward. The high boiling point refrigerant 23 in container 20 is then charged into refrigeration circuit 100 through second port 12.

Low boiling point refrigerant 25 and medium boiling point refrigerant 24 have small molecular weights and can pass through throttle device 6 and auxiliary throttle device 5 relatively easily. Therefore, low boiling point refrigerant 25 and medium boiling point refrigerant 24 charged into the low pressure circuit from second port 12 can pass through throttle device 6 and auxiliary throttle device 5 and flow into the high pressure circuit. In addition, the total ratio of medium boiling point refrigerant 24 and low boiling point refrigerant 25 to the total weight of the refrigerants enclosed in container 20 is 50 mass % or less. Further, the low pressure circuit includes members with a relatively large volume (that is, evaporator 8, outer tube 4*b* of first heat exchanger 4, outer tube 7*b* of second heat exchanger 7, and refrigerant tank 9). Therefore, even when low boiling point refrigerant 25 and medium boiling point refrigerant 24 are charged into the low pressure circuit from second port 12, the pressure rise in the low pressure circuit is relatively suppressed. After low boiling point refrigerant 25 and medium boiling point refrigerant 24 are charged into the low pressure circuit from second port 12, high boiling point refrigerant 23 thus can be charged into the low pressure circuit from second port 12. In other words, using second port 12 in place of first port 11 can also charge substantially the entire amount of refrigerants in container 20. Depending on the type of compressor 1, the low pressure portion of the compressor 1 may have a relatively large volume. In this case, compressor 1 also becomes a member constituting the low pressure circuit and having a relatively large volume.

In addition, charging low boiling point refrigerant 25, medium boiling point refrigerant 24, and high boiling point refrigerant 23 in this order from second port 12 can effectively eliminate retention of lubricating oil and improve the start-up performance of compressor 1. This point will be explained below.

When refrigeration circuit 100 is stopped before refrigerant charging, lubricating oil for lubricating compressor 1 may be retained in a low-temperature and large-volume portion, such as evaporator 8, while the temperature of the lubricating oil has dropped and the viscosity of the lubricating oil has increased. When a hydrocarbon (for example, ethane) is used as a medium boiling point refrigerant, medium boiling point refrigerant 24, which is highly compatible with the lubricating oil for lubricating compressor 1, can be charged into the low pressure circuit. Therefore, by bringing medium boiling point refrigerant 24 into contact with the lubricating oil retained in evaporator 8, the viscosity of the lubricating oil can be reduced. Subsequently, when high boiling point refrigerant 23 is charged, low boiling point refrigerant 25 and medium boiling point refrigerant 24 (which have charged in advance) relatively easily pass through throttle device 6 and auxiliary throttle device 5 and flow into high pressure circuit side. At this time, the lubricating oil, whose viscosity has been reduced, is carried along with the refrigerants and spreads throughout refrigeration circuit 100. In other words, the lubricating oil can permeate through the refrigeration circuit.

At this time, refrigeration circuit 100 is in a state such that high boiling point refrigerant 23 is located in the low pressure circuit, and low boiling point refrigerant 25 and medium boiling point refrigerant 24 are located in the high pressure circuit. When compressor 1 is started in this state, the refrigerant that is sucked in and compressed is mainly high boiling point refrigerant 23. High boiling point refrigerant 23 has a higher boiling point than low boiling point refrigerant 25 and medium boiling point refrigerant 24; therefore, high boiling point refrigerant 23 would have a lower pressure than low boiling point refrigerant 25 and medium boiling point refrigerant 24 when the refrigerants are in the same temperature environment. In other words, the discharge pressure of compressor 1 does not become high at the time of starting of the compressor, and therefore compressor 1 can be easily started up at a relatively low load.

As described above, the port to which container 20 is first connected may be first port 11 or second port 12. The port to be used first for the refrigerant charging from container 20 can be determined by detecting the state of refrigeration circuit 100 or a refrigeration apparatus including refrigeration circuit 100 and based on the detected state.

That is, the following is possible: the state of refrigeration circuit 100 or a refrigeration apparatus including refrigeration circuit 100 is detected, and based on the detected state, mouth 22 is connected to second port 12 in place of first port 11. In this case, at least a portion of the refrigerant in container 20 is charged into refrigeration circuit 100 through second port 12 from container 20 in a position such that mouth 22 faces upward. After that, the position of container 20 is changed so that mouth 22 faces downward, and the refrigerant remaining in container 20 is charged.

The state of refrigeration circuit 100 or a refrigeration apparatus including refrigeration circuit 100 is detected by a temperature sensor attached to refrigeration circuit 100 or the refrigeration apparatus before the refrigerant is charged and when refrigeration circuit 100 is operating.

An exemplary relationship between the installation location of the temperature sensor, the detection result from the temperature sensor, and the port through which a refrigerant is charged is as shown in Table 1. When refrigeration circuit 100 is applied to a cold storage such as an ultra-low temperature freezer, a temperature sensor that detects the temperature inside the storage is used in addition to the temperature sensors shown in Table 1 for determination. Hereinafter, a case where refrigeration circuit 100 is applied to a cold storage such as an ultra-low temperature freezer will be described.

TABLE 1

| Installation location of temperature sensor | Detection result | Port |
|---|---|---|
| Outlet of condenser | Abnormally high temperature | First port |
| Inlet of evaporator | Abnormally high temperature | First port |
| Outlet of evaporator | Abnormally high temperature | Second port |
| Inlet or outlet of outer tube of first heat exchanger | Abnormally high temperature | First port |
| In inner tube of first heat exchanger | Abnormally high temperature | Second port |

When the refrigerant temperature at the outlet of condenser 2 is higher than a predetermined value and the temperature inside the storage is higher than a predetermined value—that is when the detection results of the temperature sensor at the outlet of condenser 2 and the temperature sensor for measuring the temperature inside the storage indicate abnormally high temperatures, the following abnormality may have occurred. That is, there is a possibility that clogging due to lubricating oil or impurities, which may cause poor condensation in inner tube 4*a* of first heat exchanger 4, has occurred. That is, there is a possibility that an abnormality has occurred in the high pressure circuit (particularly in inner tube 4*a* of the first heat exchanger). The clogging due to the lubricant or impurities may be caused by poor condensation in condenser 2 (for example, failure of the fan motor). Therefore, in this case, first port 11 is used for the refrigerant charging. Charging a refrigerant through first port 11 can eliminate the above-described problem.

When the refrigerant temperature at the inlet of evaporator 8 is higher than a predetermined value and the temperature inside the storage is higher than a predetermined value—that is when the detection results of the temperature sensor at the inlet of evaporator 8 and the temperature sensor for measuring the temperature inside the storage indicate abnormally high temperatures, the following abnormality may have occurred. That is, there is a possibility that clogging due to lubricating oil or impurities has occurred in throttle device 6 or the high pressure circuit. That is, there is a possibility that an abnormality has occurred in the high pressure circuit. Therefore, in this case, first port 11 is used for the refrigerant charging. Charging a refrigerant through first port 11 can eliminate the above-described problem.

When the refrigerant temperature at the outlet of evaporator 8 is higher than a predetermined value and the temperature inside the storage is higher than a predetermined value—that is when the detection results of the temperature sensor at the outlet of evaporator 8 and the temperature sensor for measuring the temperature inside the storage indicate abnormally high temperatures, the following abnormality may have occurred. That is, there is a possibility that clogging due to lubricating oil or impurities has occurred in evaporator 8 or in other portions of the low pressure circuit. Alternatively, lubricating oil may be retained inside evaporator 8. That is, there is a possibility that an abnormality has occurred in the low pressure circuit. Therefore, in this case, second port 12 is used for the refrigerant charging. Charging a refrigerant through second port 12 can eliminate the above-described problem.

When the refrigerant temperature at the inlet or the outlet of inner tube 4*a* of first heat exchanger 4 is higher than a predetermined value and the temperature inside the storage is higher than a predetermined value—that is when the detection results of the temperature sensor at the inlet or the outlet of inner tube 4*a* of first heat exchanger 4 and the temperature sensor for measuring the temperature inside the storage indicate abnormally high temperatures, the following abnormality may have occurred. That is, there is a possibility that clogging due to lubricating oil or impurities, which may cause poor condensation of a refrigerant in inner tube 4*a* of first heat exchanger 4, has occurred. That is, there is a possibility that an abnormality has occurred in the high pressure circuit (particularly in inner tube 4*a* of the first heat exchanger). Therefore, in this case, first port 11 is used for the refrigerant charging. Charging a refrigerant through first port 11 can eliminate the above-described problem.

When the refrigerant temperature at the inlet or the outlet of outer tube 4*b* of first heat exchanger 4 is higher than a predetermined value and the temperature inside the storage is higher than a predetermined value—that is when the detection results of the temperature sensor at the inlet or the outlet of outer tube 4*b* of first heat exchanger 4 and the temperature sensor for measuring the temperature inside the storage indicate abnormally high temperatures, the following abnormality may have occurred. That is, there is a possibility that clogging with lubricating oil or impurities, which may cause insufficient evaporation of a refrigerant in outer tube 4*b* of first heat exchanger 4, has occurred. That is, there is a possibility that an abnormality has occurred in the low pressure circuit (particularly in outer tube 4*b* of the first heat exchanger). Therefore, in this case, second port 12 is used for the refrigerant charging. Charging a refrigerant through second port 12 can eliminate the above-described problem.

That is, when there is an abnormality in the temperature of a refrigerant flowing from compressor 1 to throttle device 6, mouth 22 of container 20 is connected to first port 11 to charge a refrigerant. When there is an abnormality in the temperature of a refrigerant flowing from throttle device 6 to compressor 1, mouth 22 of container 20 is connected to second port 12 to charge a refrigerant. In other words, in place of connecting mouth 22 of container 20 to first port 11, the mouth is connected to second port 12.

The detection results of the temperature sensors are recorded as a log in the control device of the refrigeration apparatus. The control device may determine the port through which a refrigerant is charged based on the log, and display the result of the determination on a display device provided in the refrigeration apparatus. An operator can view this display and charge a refrigerant through the appropriate port.

The present disclosure is not limited to the embodiments described above, and various modifications are also included in the present disclosure without departing from the spirit of the present disclosure.

Figure 5:
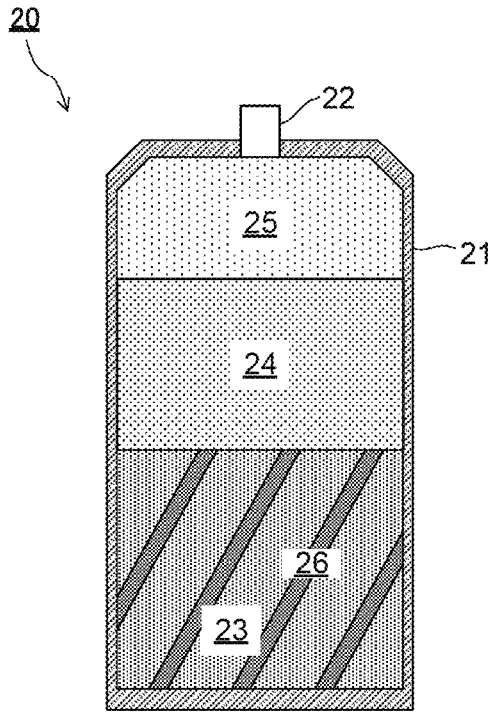
FIG. 5 schematically illustrates the container and the refrigerants and an oil carrier agent in the container.

For example, as illustrated in FIG. 5, container 20 may contain enclosed therein oil carrier agent 26 that is charged into refrigeration circuit 100 together with a non-azeotropic refrigerant mixture. With the total of the contents of container 20 (i.e., the total of the non-azeotropic refrigerant mixture and oil carrier agent 26) being 100 wt %, 0.14 wt % or more and 14 wt % or less of oil carrier agent 26 may be enclosed in container 20. The oil carrier agent may be, for example, normal pentane or propane.

The oil carrier agent is in a liquid form in container 20 in a room temperature environment. The oil carrier agent is in a liquid state and thus mixes with high boiling point refrigerant 23 in a liquid form. Therefore, when container 20 is in a position such that mouth 22 faces downward, the oil carrier agent is charged into refrigeration circuit 100 together with high boiling point refrigerant 23 in a liquid form. Therefore, by connecting mouth 22 of container 20 to second port 12 and charging a refrigerant through the second port, the oil carrier agent can first be brought into contact with a refrigerant retained in the low pressure circuit. This configuration thus allows the retained refrigerant to quickly permeate through refrigeration circuit 100. Furthermore, using container 20 in which an oil carrier agent is enclosed in addition to a non-azeotropic refrigerant mixture can charge the oil carrier agent into refrigeration circuit 100 during the refrigerant charging step without performing a special step for charging the oil carrier agent.

Compressor 1 may be a compressor that does not require lubricating oil. In this case, first, high boiling point refrigerant 23 is charged from first port 11, and then low boiling point refrigerant 25 and medium boiling point refrigerant 24 are charged from second port 12. The low pressure circuit has a relatively large volume, and thus the pressure rise in the low pressure circuit can be suppressed to some extent. The high pressure circuit has a relatively small volume, and thus high boiling point refrigerant 23 flows from the high pressure circuit into the low pressure circuit through throttle device 6 and auxiliary throttle device 5. That is, the pressure rise in the high pressure circuit is suppressed to some extent. Therefore, the discharge pressure of compressor 1 does not become high at the time of starting of the compressor, and thus compressor 1 can be easily started up at a relatively low load even without lubricating oil.

Figure 6:
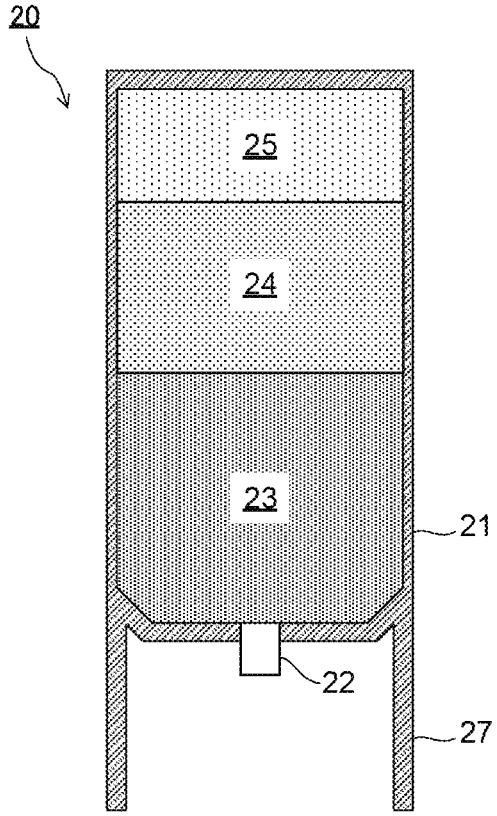
FIG. 6 schematically illustrates a variation of the container and the refrigerants therein.

Container 20 may include skirt 27, as illustrated in FIG. 6. Providing skirt 27 allows container 20 to stably stand on its own horizontally even when mouth 22 faces downward. A similar mouth 22 may be formed at a location (at a region corresponding to the bottom of container in FIG. 6) symmetrical to mouth 22. Providing skirt 27 can improve the workability of the refrigerant charging into refrigeration circuit 100.

The path switching device provided in jig 30 may be configured with one three-way valve in place of the two valves 34.

The refrigeration apparatus may include two refrigeration circuits 100.

In the case where the performance of refrigeration circuit 100 can be fully utilized, low boiling point refrigerant 23 does not have to be enclosed in container 20, and only medium boiling point refrigerant 24 and high boiling point refrigerant 25 may be enclosed as refrigerants constituting a non-azeotropic refrigerant mixture.

This application is entitled to and claims the benefit of Japanese Patent Application No. 2022-54135 filed on Mar. 29, 2022, the disclosure of which including the specification, claims, drawings, and abstract is incorporated herein by reference in its entirety.

INDUSTRIAL APPLICABILITY

The present disclosure is applicable to various refrigeration apparatuses (such as ultra-low temperature storages, ultra-low temperature freezers, medicine refrigerators, blood refrigerators, and incubators) each using a non-azeotropic refrigerant mixture as the refrigerant thereof. In addition, refrigeration apparatuses used in environments without gravity, such as zero gravity or microgravity (for example, a space environment), include compressors that do not require lubricating oil. The present disclosure can be applied to a refrigeration apparatus equipped with such a compressor, and can be extremely effectively utilized industrially.

REFERENCE SIGNS LIST

100 Refrigeration circuit
1 Compressor
2 Condenser
3 Gas-liquid separator
4 First heat exchanger
4*a* Inner tube
4*b* Outer tube
5 Auxiliary throttle device
6 Throttle device
7 Second heat exchanger
7*b* Outer tube
8 Evaporator
9 Refrigerant tank
10 Refrigerant tank connecting throttle device
11 First port
12 Second port
20 Container

21 Container main body
22 Mouth
23 High boiling point refrigerant
24 Medium boiling point refrigerant
25 Low boiling point refrigerant
26 Oil carrier agent
27 Skirt
30 Jig
31 Container connection port
32 Branch pipe
33 Port connection port
34 Valve

The invention claimed is:

1. A method for charging a refrigerant into a refrigeration circuit that includes a compressor, a condenser, a throttle device, an evaporator and a second port, the second port being disposed in a low pressure portion of the compressor or in a location upstream of the compressor and downstream of the throttle device, the method comprising:

connecting, to the second port, a mouth of a container in which the refrigerant is enclosed, the refrigerant including a high boiling point refrigerant in a liquid state and a medium boiling point refrigerant including a boiling point lower than that of the high boiling point refrigerant and in a wet gas state;

charging, from the container in a position such that the mouth faces upward, at least a portion of the refrigerant in a wet gas state in the container into the refrigeration circuit through the second port; and after charging the at least a portion of the refrigerant in the wet gas state into the refrigeration circuit through the second port, and charging, from the container in a position such that the mouth faces downward, at least a portion of the refrigerant in a liquid state in the container into the refrigeration circuit through the second port.

2. The method according to claim 1, further comprising:

by charging the at least portion of the refrigerant in a liquid state in the container into the refrigeration circuit through the second port, bringing at least a portion of the refrigerant charged through the second port into contact with lubricating oil retained in the evaporator;

reducing viscosity of the lubricating oil; and causing the lubricating oil to permeate through the refrigeration circuit.

3. The method according to claim 1, wherein a low boiling point refrigerant having a boiling point lower than that of the medium boiling point refrigerant and in a gas state is also enclosed in the container.

4. The method according to claim 3, wherein in the container, 50 wt % or more and 80 wt % or less of the high boiling point refrigerant, 10 wt % or more and less than 50 wt % of the medium boiling point refrigerant, and 20 wt % or less of the low boiling point refrigerant are enclosed.

5. The method according to claim 3, wherein:

the high boiling point refrigerant is normal butane or isobutene, the medium boiling point refrigerant is ethane, ethylene, or xenon, and the low boiling point refrigerant is methane or krypton.

6. The method according to claim 5, wherein:

the high boiling point refrigerant is normal butane, the medium boiling point refrigerant is ethane, and the low boiling point refrigerant is methane.

7. The method according to claim 1, wherein an oil carrier agent to be charged into the refrigeration circuit together with the refrigerant is also enclosed in the container.

8. The method according to claim 7, wherein in the container, 0.14 wt % or more and 14 wt % or less of the oil carrier agent is enclosed.

9. The method according to claim 7, wherein the oil carrier agent is normal pentane or propane.

* * * * *